US006543082B2

(12) United States Patent
Dingert et al.

(10) Patent No.: US 6,543,082 B2
(45) Date of Patent: Apr. 8, 2003

(54) HOLDER FOR SECURING A MOP AT THE END OF A HANDLE

(75) Inventors: Uwe Dingert, Abtsteinach (DE); Joerg Dunkel, Heddesheim (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/861,943

(22) Filed: May 21, 2001

(65) Prior Publication Data

US 2001/0042278 A1 Nov. 22, 2001

(30) Foreign Application Priority Data

May 22, 2000 (DE) ..... 100 24 996

(51) Int. Cl.[7] ..... A47L 13/20

(52) U.S. Cl. ..... 15/147.1; 15/229.1; 15/229.2; 15/229.6; 15/228

(58) Field of Search ..... 15/147.1, 229.7, 15/229.1, 49.1, 229.6, 229.2, 120.1, 228

(56) References Cited

U.S. PATENT DOCUMENTS 1,899,845 A * 2/1933 Benedict ..... 15/229.2
3,682,516 A * 8/1972 Savage ..... 15/145
4,580,307 A * 4/1986 Moss ..... 15/144.2
5,199,130 A 4/1993 Lazar
5,414,889 A * 5/1995 Sartori ..... 15/144.1
6,161,242 A * 12/2000 Cabrero Gomez et al. 15/147.1

FOREIGN PATENT DOCUMENTS

| | | |
|---|---|---|
| DE | 198 33 553 | 12/1999 |
| ES | 1 043 526 | 1/2000 |

* cited by examiner

*Primary Examiner*—Robert J. Warden, Sr.
*Assistant Examiner*—Laura C Cole
(74) *Attorney, Agent, or Firm*—Kenyon & Kenyon

(57) ABSTRACT

A holder for securing mop at the end of a handle, in which a plurality of relatively moveable, absorbent strips made of a textile material are affixed as a result of being clamped between a headpiece and a plate, essentially at right angles to the longitudinal axis of the handle. In the region where the strips are fastened, the holder has a surface area having a length greater than its width, and boundary edges of which are curved to form two corners, without changing the direction of the curvature.

21 Claims, 8 Drawing Sheets

HOLDER FOR SECURING A MOP AT THE END OF A HANDLE

FIELD OF THE INVENTION

The present invention relates to a holder for securing a mop at the end of a handle, a plurality of relatively movable, absorbent strips made of a textile material being clamped between a headpiece and a plate, preferably at an angular displacement relative to one another, essentially at right angles to the longitudinal axis of the handle. In this context, in the region where the strips are fastened, the holder has a surface area having a greater length than width. Such mops are used for wet-cleaning floors.

BACKGROUND INFORMATION

German Published Patent Application No. 19 833 553 describes a mop to be fastened at the end of a broom handle, including a holder to which a plurality of relatively moveable, absorbent strips made of a textile material are attached substantially at right angles to the axis of the handle. The strips are anchored in the holder via a mushroom head, the outer dimensions of which are smaller than those of the holder. The holder and the mushroom head are dome-shaped.

U.S. Pat. No. 5,199,130 describes a mop, the holder of which widens in a conical manner, the secured strips of the mop being held by a round plate provided with a central winding. In contrast to the conical holder, the plate has a flat design.

Spanish Utility Patent No. U 1,043,526 describes a mop, the holder of which has a corner extending into a point, the holder, starting out from a round, elliptical basic form in the region of the corners, having a straight-lined region over a considerable portion of its longitudinal extension, in the direction of the corner. The holder itself can have a domed design. All of the strips lie in essentially the same direction, without an angular displacement relative to one other.

It is an object of the present invention to provide a mop having an improved operability and suitability for cleaning corners.

SUMMARY

The above and other beneficial objects of the present invention are achieved by providing a mop holder having a boundary edge that cooperates with the strips of the mop and is divided into at least two edge regions extending in the direction of the longitudinal axis of the holder. Without changing the direction of the curvature, the edge regions are curved at a constant or at least sectionally changing radius of curvature. The ratio of the length to the width is at least 1.2 and at most 4, e.g., more than 1.6. The radius of curvature of the edge regions is at least 0.61-fold and at most 4.25-fold the width.

By forming two curved edge regions, the mop may be used independently of its instantaneous position, since the mop is always resting on the curved edge region. As a result of the curvature, the mop may be rotated about a certain angle of rotation, the mop rolling on the holder or the strips attached thereto. This rolling motion becomes more difficult as the angle of rotation increases, since the center of gravity of the mop is raised. It has been determined that the ratio of the length to the width should be at least 1.2 and at most 4, e.g., more than 1.6, to improve operation of the mop.

A corner provided according to one example embodiment of the present invention represents a restriction of the rotation, a significantly higher expenditure of force being necessary to overcome this restriction. Compared to a circular holder, the present holder may be simply and effortlessly used in S-motions, because of the restoring effect of the holder into a central position.

As a result of the boundary edge being capable of having a flattened region at each of the ends bordering the length to avoid acute-angled corners, it is more difficult to tip the mop over from one edge region to the other.

Furthermore, the boundary edge may include corners outside of the ends bordering the length to maintain particular geometries and rolling motions.

Each edge region may include at least one circular segment. Other curves may also be used instead of circular segments if the tendency of the holder to rotate or the positional stability is to be changed.

When both circular segments are in mirror symmetry, operation is independent of the use of a particular boundary edge.

If different degrees of rotatability are to be provided, the curvature of the first edge region may be selected to be greater than the curvature of the second edge region.

The angle enclosed by the tangents positioned at both ends bordering the length is at most 90°, so that corners typically occurring in structures may also be cleaned.

To increase the radius of curvature, the headpiece may be pulled down at its corners, thereby altogether resulting in a spatial curvature of the edge regions.

To further improve the rotatability of the mop, the holder may be connected to the handle via a tilting joint movable in the longitudinal direction of the holder.

An arrangement may be provided on the joint for restricting the tilting angle of +/−60° with respect to the vertical line to the longitudinal axis of the holder. Restricting the tilting angle to +/−25° may be particularly advantageous, since, this makes it possible to also lightly wring out the mop in a sieve without the holder significantly deflecting.

According to another aspect of the present invention, the surface area of the plate may be greater than that of the headpiece, thereby causing the plate to project beyond the headpiece on the peripheral side. This arrangement the advantage that the active wiping width is enlarged without increasing the amount of wiping material, particularly of the strips. Furthermore, the force is transferred to the strips of the mop via a hard edge, so that, in addition to wiping, it is also possible to scrape to a certain extent.

To improve the rigidity, the headpiece may include a dome-shaped, e.g., concave, design. An edge may be formed at the junction of the dome-shaped partial sections formed across the edge region.

The edges may be rounded off with a radius between 0.05-fold and 0.25-fold the width of the holder, so that a rolling motion over the corners is possible although an increased expenditure of force is necessary with respect to the rolling motion on the outer edge.

When the corners are rounded off, a ratio of the length to the width of at most 2.4 and of radius of curvature (R) to width (B) of at most 3.38 may also be used, a ratio of the length to the width of approximately 1.8 having been proven to be particularly advantageous. The length of the holder with respect to a length having corners in the region of the ends bordering the length may be between 0.99-fold and 0.6-fold, e.g., between 0.95-fold and 0.85-fold, since in this region, another satisfactory improvement in wiping performance and the operability is achieved, without forming actual corners that could cause damage when the mop is handled inappropriately.

DETAILED DESCRIPTION

Figure 1:
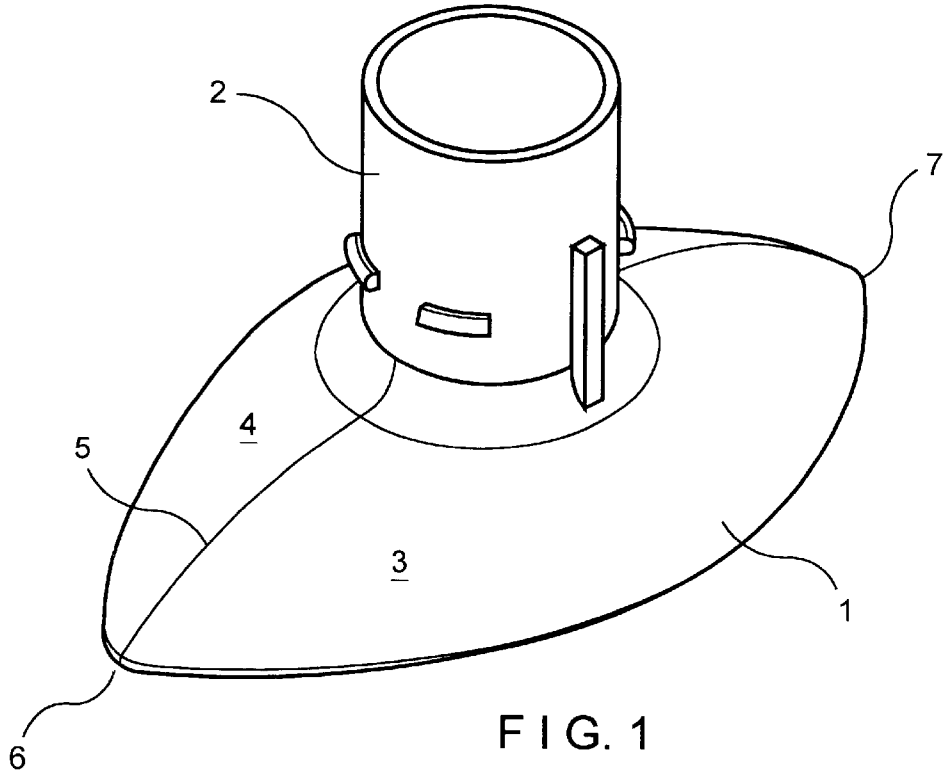
FIG. 1 is a perspective view of a headpiece of a holder according to the present invention.

FIG. 1 illustrates a holder for securing a mop to the end of a handle. The holder includes a headpiece 1 to which a cylindrical connector 2 for latching to a counterpart of a handle (not shown) is connected in one piece. Headpiece 1 includes two dome-shaped half-shells 3, 4 that meet to form an edge 5 and are also integrally connected.

Headpiece 1 has an oblong shape, i.e., the length and width are noticeably different. Furthermore, corners 6, 7 are formed on headpiece 1, these corners 6, 7 being located at the respective ends of headpiece 1, the ends being configured in the longitudinal direction. Half-shells 3, 4 are formed between the two corners 6, 7 so that they have a radius of curvature that is greater than half of the width of headpiece 1, without changing the direction of the curvature. Corners 6, 7 are rounded off.

Figure 2:
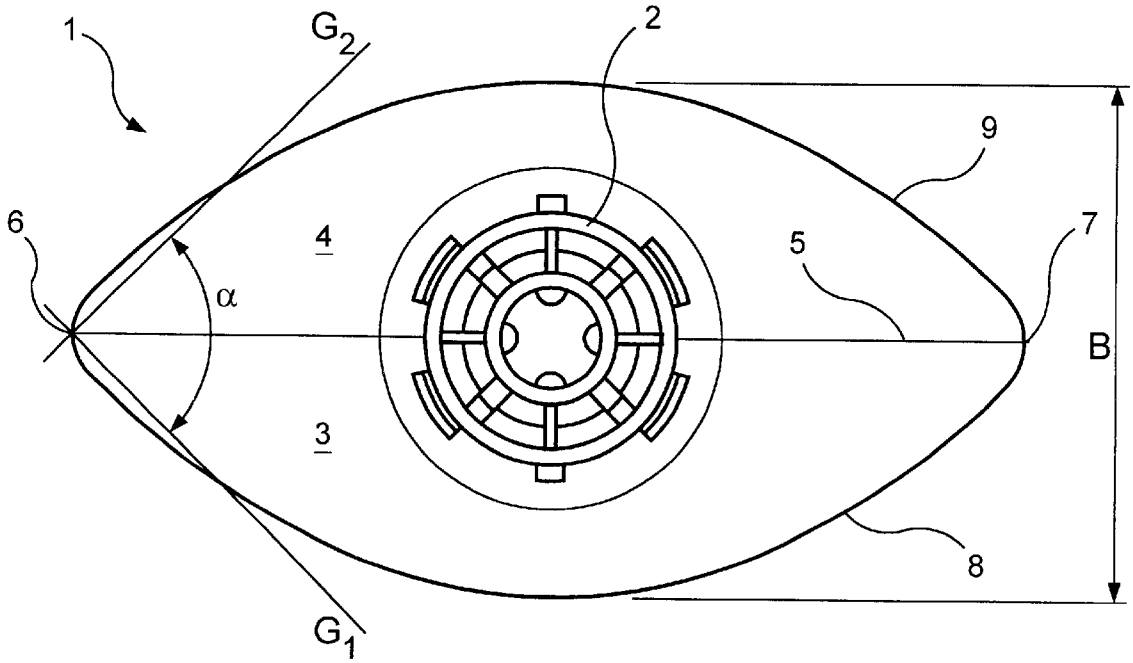
FIG. 2 is a top view of the headpiece illustrated in FIG. 1.

The geometric proportions of the headpiece with respect to the surface area become even more apparent from FIG. 2. Headpiece 1 including the centrically situated connector 2 can first be recognized. Half-shells 3 and 4 extend around this coupling 2 to an outer contour line 8, 9, as well as to corners 6, 7, while forming edge 5. Curved contour line 8, 9 extends from corner 6 to corner 7 with a curvature so that the longitudinal extension from corner 6 to corner 7 is noticeably greater than width B. Outer contours 8, 9 may be at least partially configured as circular arcs, the radius of curvature of which is significantly greater than the distance to the center axis of headpiece 1, the center axis passing through corners 6, 7.

The ratio of length to width is approximately 1.8. It should be appreciated that as the ratio increases, corners 6, 7 become increasingly pointed and that an increasingly narrow headpiece 1 is produced. As the ratio decreases, the surface area of the headpiece approaches the shape of a circle. However, according to the present invention, a surface area specifically deviating from a circle is to be provided.

Figure 3:
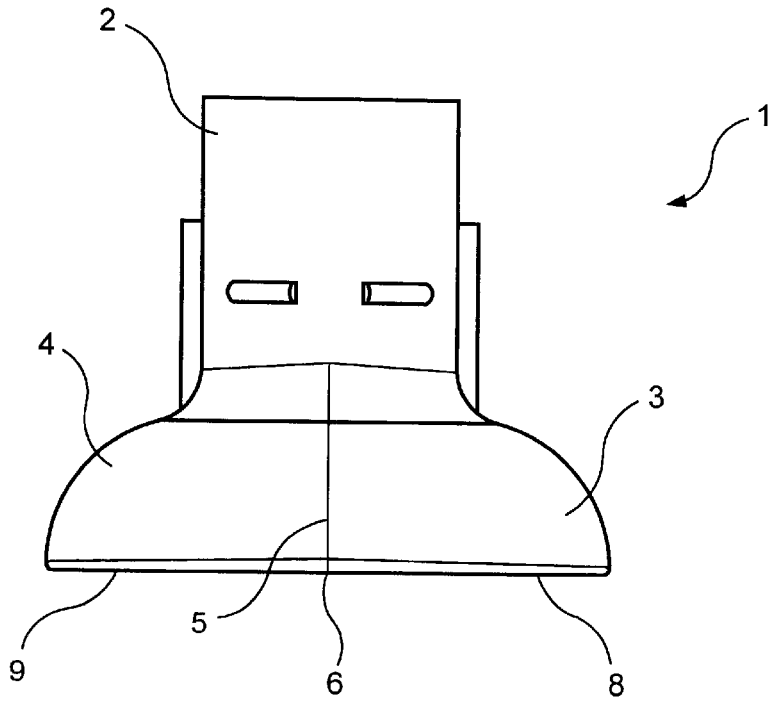
FIG. 3 is a front view of the holder illustrated in FIG. 1.
Figure 4:
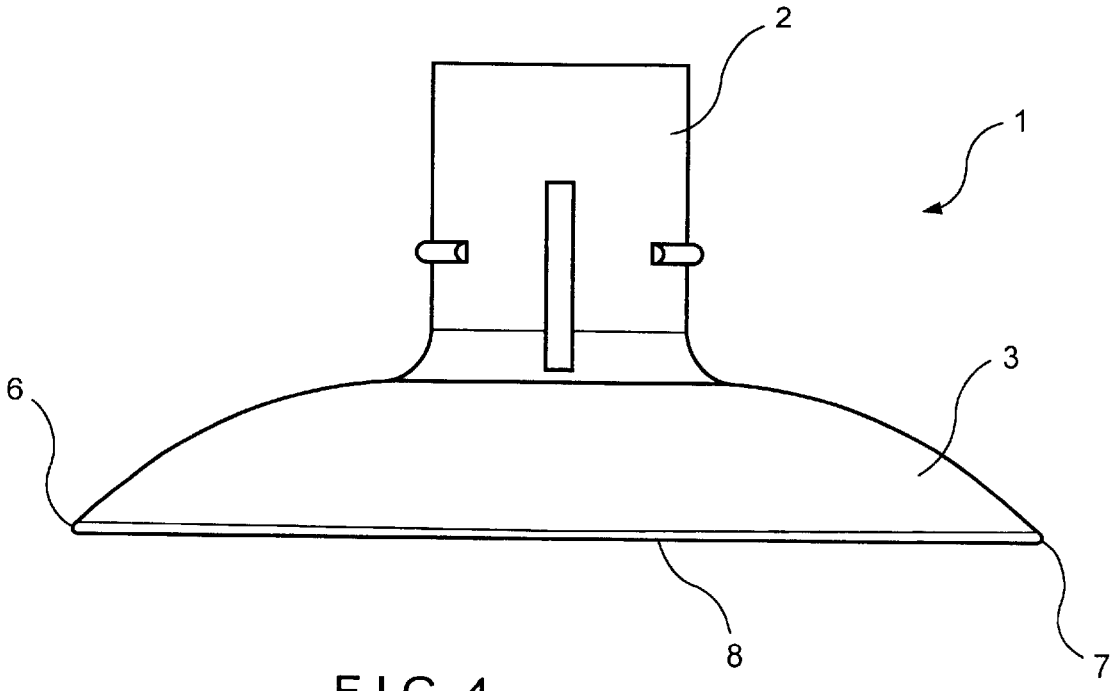
FIG. 4 is a lateral view of the headpiece illustrated in FIG. 1.

The characteristic of the curvature of the half-shells 3, 4 is illustrated in FIGS. 3 and 4, as are the configuration of edge 5 and of corners 6, 7 and the position of outer contours 8, 9. As a result of dome-shaped half-shells 3, 4 extending upwardly to coupling 2, force may be transferred via headpiece 1 to corners 6, 7, without the holder being considerably deformed. The rigidity produced by this form is significantly improved in comparison with a simple plate.

Figure 5:
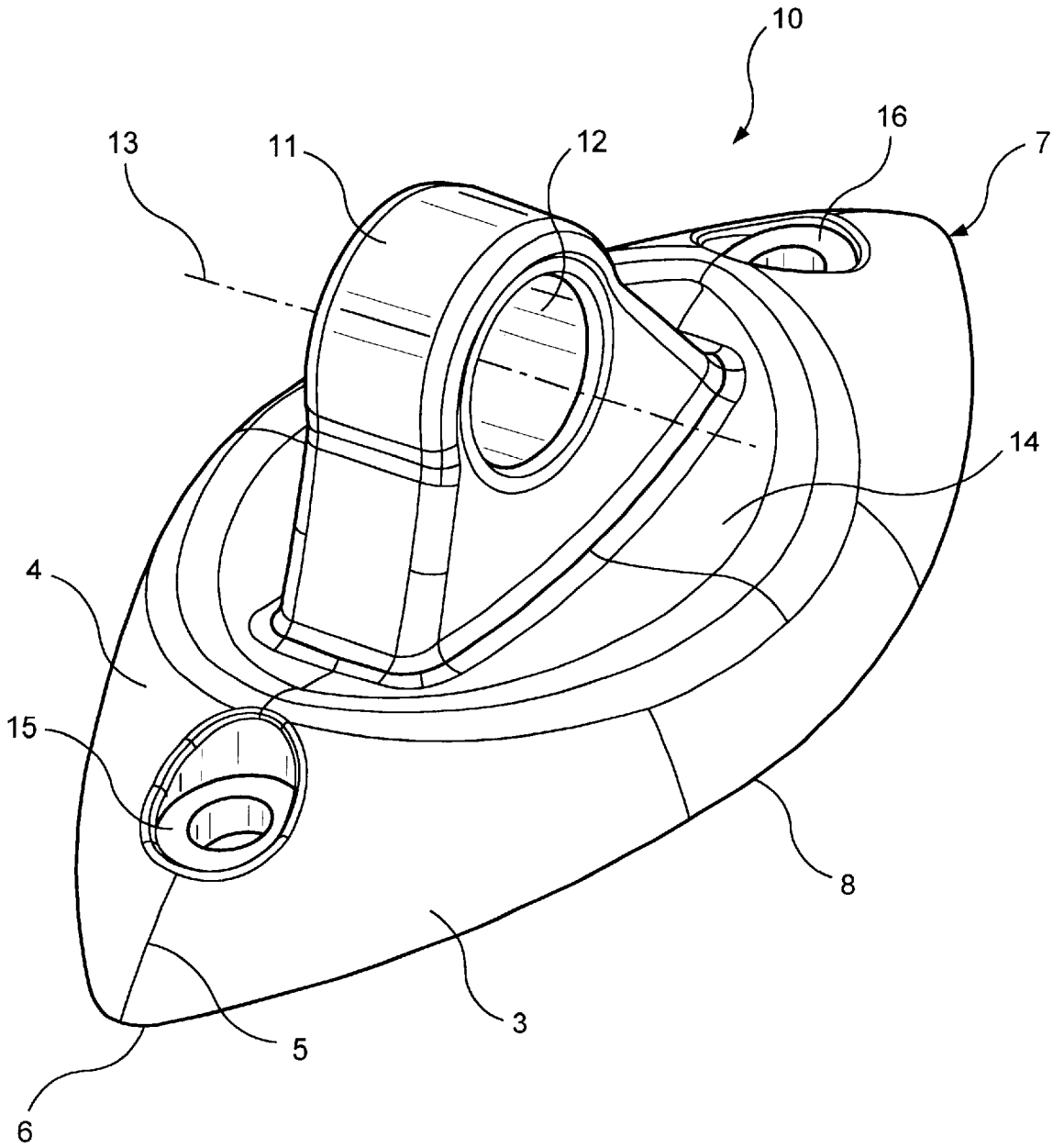
FIG. 5 is a perspective view of another example embodiment of the present invention including a headpiece having a tilting joint.

FIG. 5 illustrates a further example embodiment of a headpiece 10 according to the present invention, the headpiece being connected to a handle (not shown) via a tilting joint. Headpiece 10 includes an eye 11 having a through hole 12. Eye 11 is situated in the longitudinal direction, i.e., in a direction parallel to the intended connection of corners 6 and 7, on the topside of half-shells 3, 4, and opening 12, which secures tilt axis 13, extends in the direction of the width of headpiece 10.

It should be understood that it is possible to tilt the handle about tilt axis 13 as a result of a handle having an extension that mates with opening 12 and is in a direction perpendicular to the handle axis. Thus, corners 6, 7 of headpiece 10 may be moved toward and away from the handle. No further degrees of freedom of movement of headpiece 10 with respect to the handle are provided.

Figure 6A:
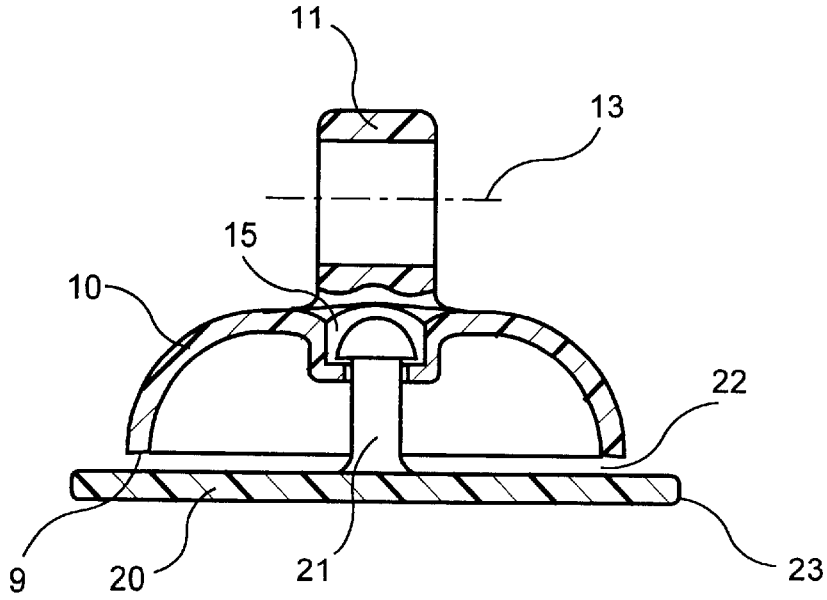
FIG. 6*a* is a cross-sectional view of a further example embodiment of the present invention including a plate projecting beyond the headpiece.

To maintain the distance from tilting axis 13 to outer contour 8 as a supporting edge on the textile material as minimal as possible, convexly formed half-shells 3, 4 include a concave recess 14, which accommodates eye 11. Furthermore, receiving openings 15, 16 are provided that are situated between the eye and corners 6, 7, respectively, and are used to secure a plate to headpiece 10. The figures illustrate the complete holder excluding the strips of textile material. FIG. 6*a* shows the schematic arrangement of headpiece 10 including a plate 20, the connection being achieved by receiving opening 15 and a pin 21 protruding from plate 20, the pin projecting through headpiece 10 and being secured in receiving opening 15. In space 22 between headpiece 10 and plate 20 are the mop strips, which are thus clamped between outer contour 9, as the bottom edge of headpiece 10, and the topside of plate 20. Headpiece 10 is able to be tilted about tilting axis 13 of the handle (not shown).

Figure 6B:
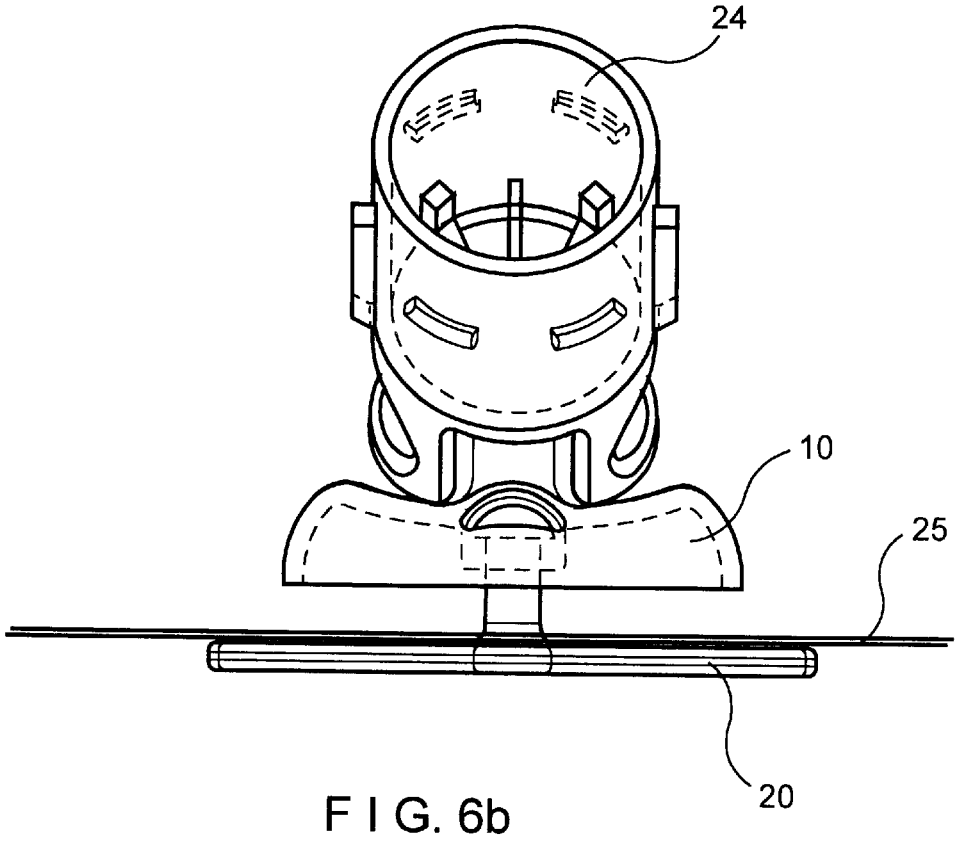
FIG. 6*b* is a front view of the example embodiment of the present invention illustrated in FIG. 6*a*.

Furthermore, it should be understood that the outer dimensions of plate 20 exceed those of headpiece 10, so that there is a projection on the edge. FIG. 6*b* illustrates an example embodiment including all occurring edges, a coupling 24 facing the handle being shown in a tipped position. Moreover, strips 25, which are situated between plate 20 and the headpiece 10, which is curved in a dome-shaped manner, are at least partially illustrated.

Figure 7A:
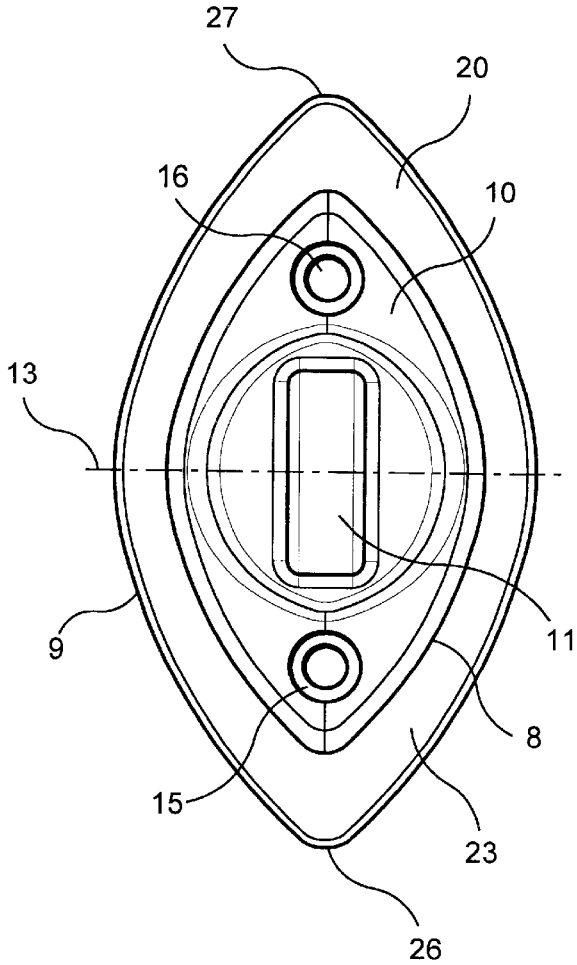
FIG. 7*a* is a top view of the holder illustrated in FIG. 6*a*.

As illustrated in FIG. 7*a*, the design of the holder becomes particularly clear by omitting the strips, because the size ratios of headpiece 10 and plate 20 become clear. It can be clearly seen that plate 20 extends beyond outer boundary 8 of headpiece 10 and has a projection 23 along the entire outer contour 8, 9. Plate 20 is formed so that the geometry described for the headpiece and illustrated in FIGS. 1 through 4 is achieved, that the length is, therefore, greater than the width, and that, at the elongated ends, corners 26, 27 are formed and then rounded off. The angular ratios illustrated in FIG. 2 are achieved in the region of corners 6, 7, or in terms of plate 20, corners 26, 27.

Lines G1, G2, which pass through the outer point of corner 6 and the longitudinal axis of headpiece 1, are drawn in corner 6. Lines G1, G2 form an angle a, which is approximately 90°, the angle being slightly larger than 90° in the illustrated example embodiment. This example embodiment enables a significant improvement of the ability to clean corners. However, it is particularly advantageous when lines G1, G2 have a 90° angle completely outside of headpiece 1.

Furthermore, the arrangement of eye 11 and tilting axis 13 as well as the position of receiving openings 15, 16 for the fasteners of plate 20 are illustrated in FIG. 7*a*.

Figure 7B:
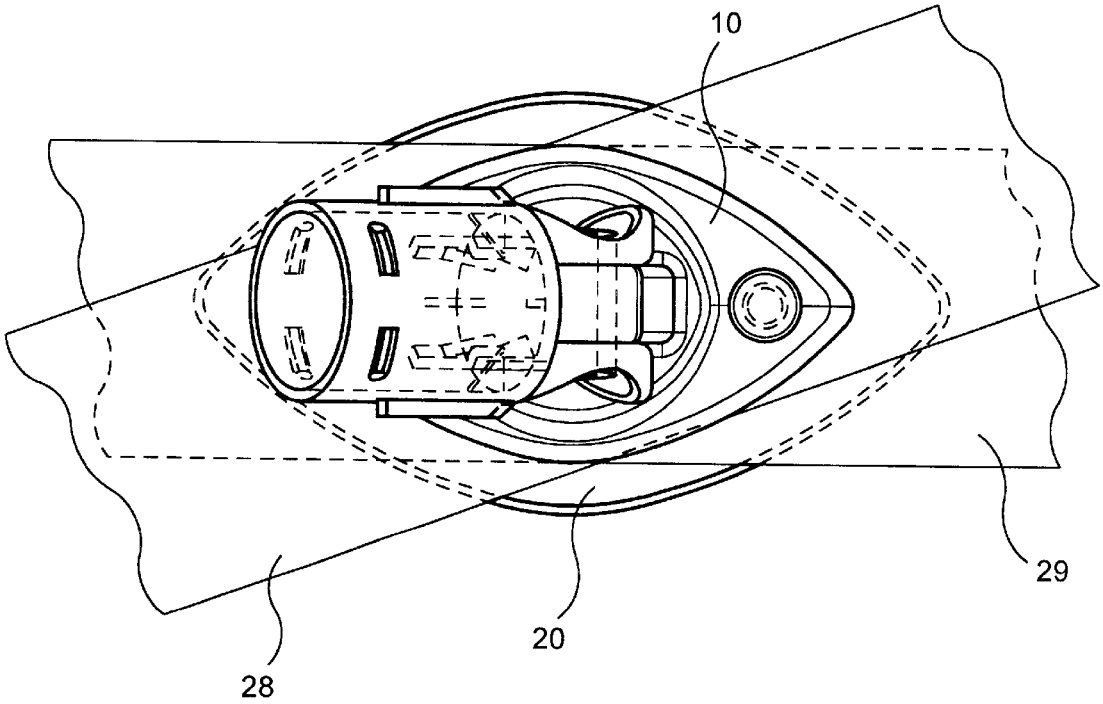
FIG. 7*b* is a top view of the holder illustrated in FIG. 6*b*.

FIG. 7*b* is a top view of the holder including secured strips 28, 29 made of a textile material, the width of which corresponds to the width of headpiece 10, and which have a narrower width than plate 20. However, as a result of strips 28, 29 being arranged in an offset manner, at an angle relative to one another, the entire plate 20 is completely covered by the strips. Such an arrangement of the strips is conventional.

Figures 8A, 8B:
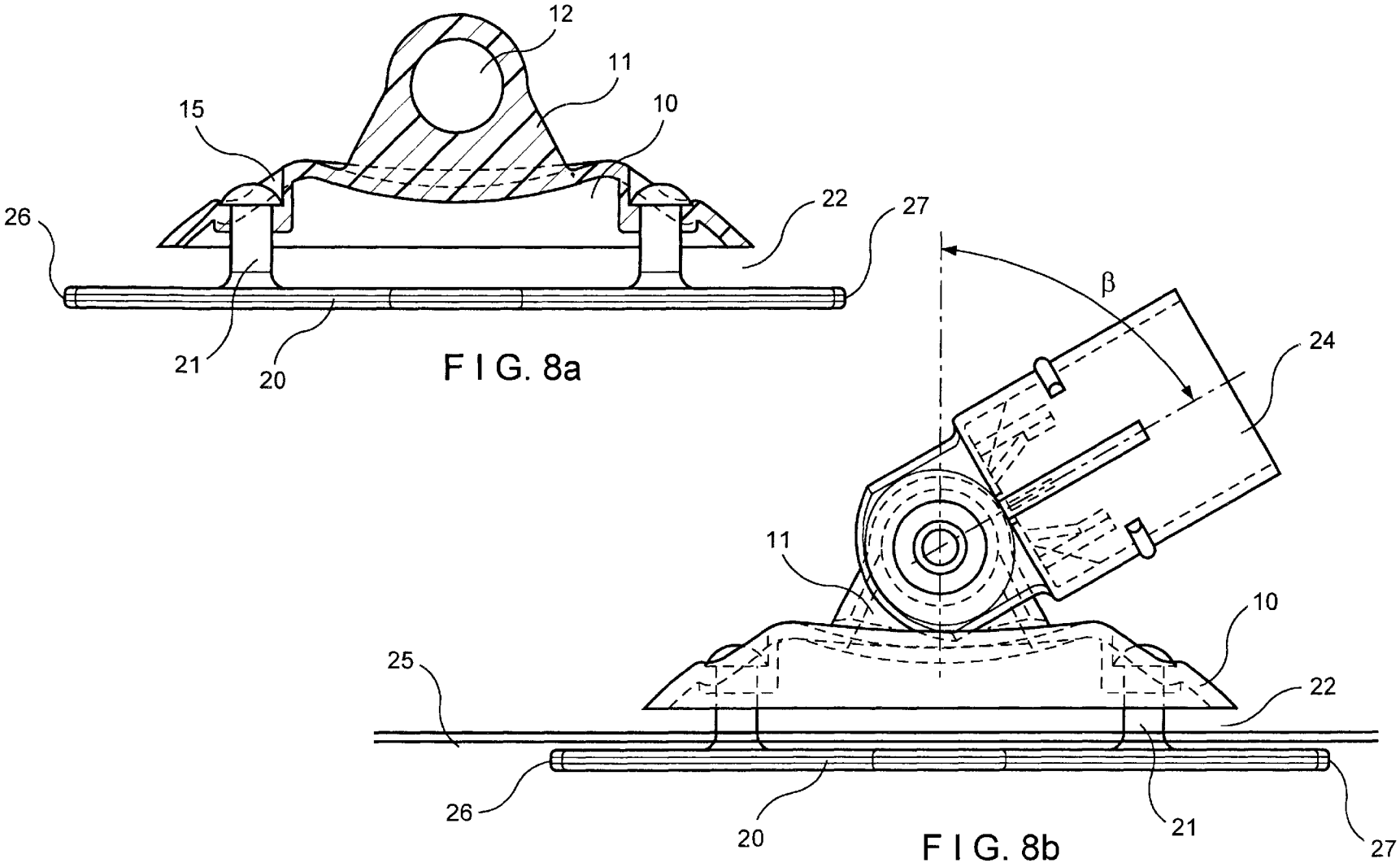
FIG. 8*a* is a longitudinal cross-sectional view of the holder illustrated in FIGS. 6*a* and 7*a*.
FIG. 8*b* is a longitudinal view of the holder illustrated in FIGS. 6*b* and 7*b*.
Figure 9:
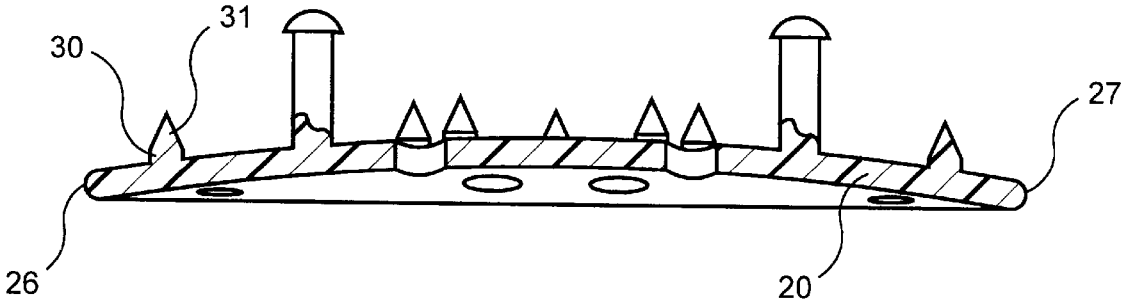
FIG. 9 is a longitudinal cross-sectional view of a plate for the holder illustrated in FIG. 6*a*.

FIG. 8*a* is a longitudinal cross-sectional view of the holder including a plate 20 projecting beyond headpiece 10, an eye 11 being present for forming a tilting joint. The mop strips may be clamped in gap 22.

FIG. 8*b* further illustrates a tilted coupling 24, which is fastened to eye 11 and connected to a handle (not shown). The illustrated tilting angle beta is approximately 60° with respect to the vertical. For improved operability, the tilting angle may, however, be restricted to +/−25°. A plurality of layers of strips 25 are partially illustrated in gap 22, plate 20 being connected to headpiece 10 via connecting means 21.

When using a plate having greater dimensions than those of the headpiece, the actual form of the headpiece is only conditionally decisive for achieving the advantages according to the present invention as long as the strips are secured between the plate and headpiece so that the wiping forces are transferred to the strips via the plate. Nevertheless, it is useful to rest the outer form of the headpiece against the form of the plate to accordingly secure the strips and compulsorily position the strips.

To generate an increased holding force of plate 20 to the headpiece, plate 20 may be curved in a non-assembled state in the direction of the side of the strips of the mop, so that, in this state, the outer boundaries as well as corners 26, 27 are supported, while the region therebetween is hollow. To prevent the strips inserted between the headpiece and plate 20 from slipping, a plurality of projections 30 having tips 31 are formed on the side facing the strips, the projections being pressed into the textile material of the strips when the holder is assembled.

Figure 10:
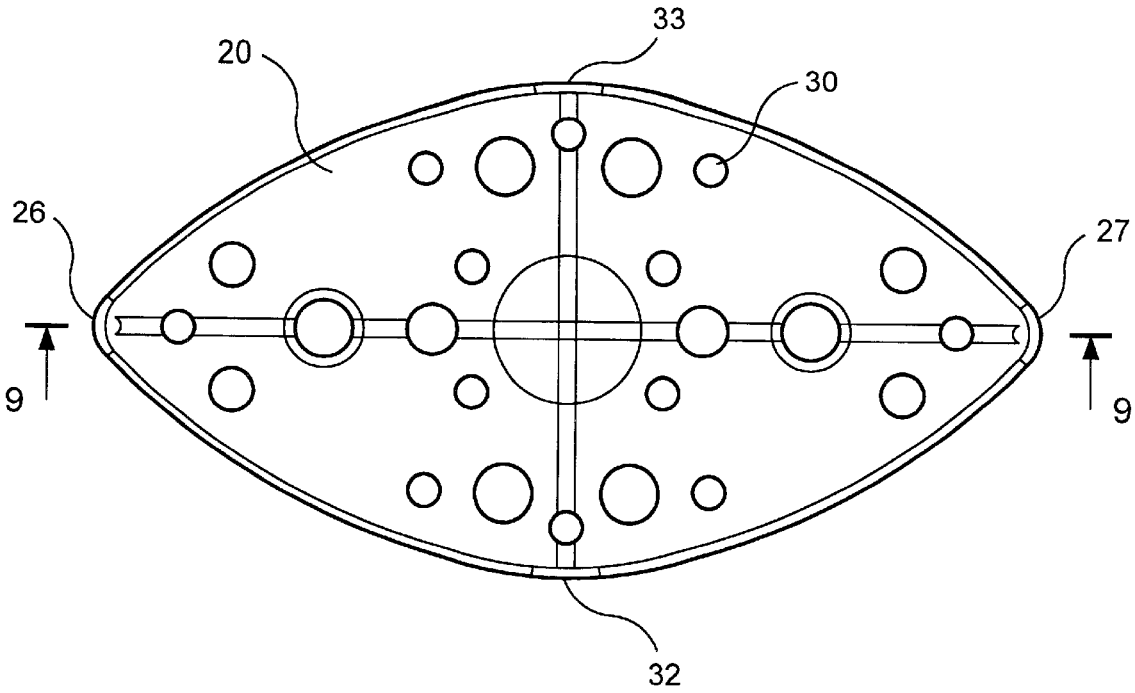
FIG. 10 is a top view of the plate illustrated in FIG. 9.

As illustrated in FIG. 10, these projections may be situated in the center region of plate 20 as well as in the region of corners 26, 27.

The geometry illustrated in FIG. 10 shows that the outer edge of the plate is curved at every point, the radius of curvature outside of corners 26, 27 being significantly greater than half of the width of plate 20. In particular, the outer boundary may be formed by a circular segment having a constant radius of curvature. However, the outer contour may also be formed of a plurality of segments having different curvatures, e.g., off our circular segments formed in the longitudinal direction by "pointed" corners 26, 27 and in the direction of the width by junction regions 32, 33 configured as obtuse corners. It is important that the radius of curvature of these long sides is significantly greater with respect to a circular surface area having the same width. The result is that the holder either including headpiece 1 or plate 20 extending beyond the headpiece and the further protruding strips of the mop may be rolled a bit on the surface to be wiped until the rolling motion reaches the corners and further rolling is opposed by a resistance.

As a result of this rolling, which, without a mechanical joint, is possible based solely on the form design according to the present invention, the operability of the mop is significantly improved for S-shaped wiping. The radius of curvature which is responsible for the rolling may be increased by corners 26, 27 or 6, 7 being pulled further downward, thereby causing the outer edge of the headpiece or the plate to be curved in a three-dimensional manner. It should be appreciated that a value of one tenth of the longitudinal extension should not be exceeded.

The ability of the mop to roll may be improved by providing a tilting joint that permits a maximum tilting angle of +/−60°. It has been shown that a tilting angle of +/−25°, for example, improves operability due to the limited angular position, particularly when wringing the mop out in a sieve. Furthermore, as a result of using the tilting joint, it is possible to purposefully direct the mop into corners and force it toward the corner, thereby making it possible to clean in the corners.

Figure 11:
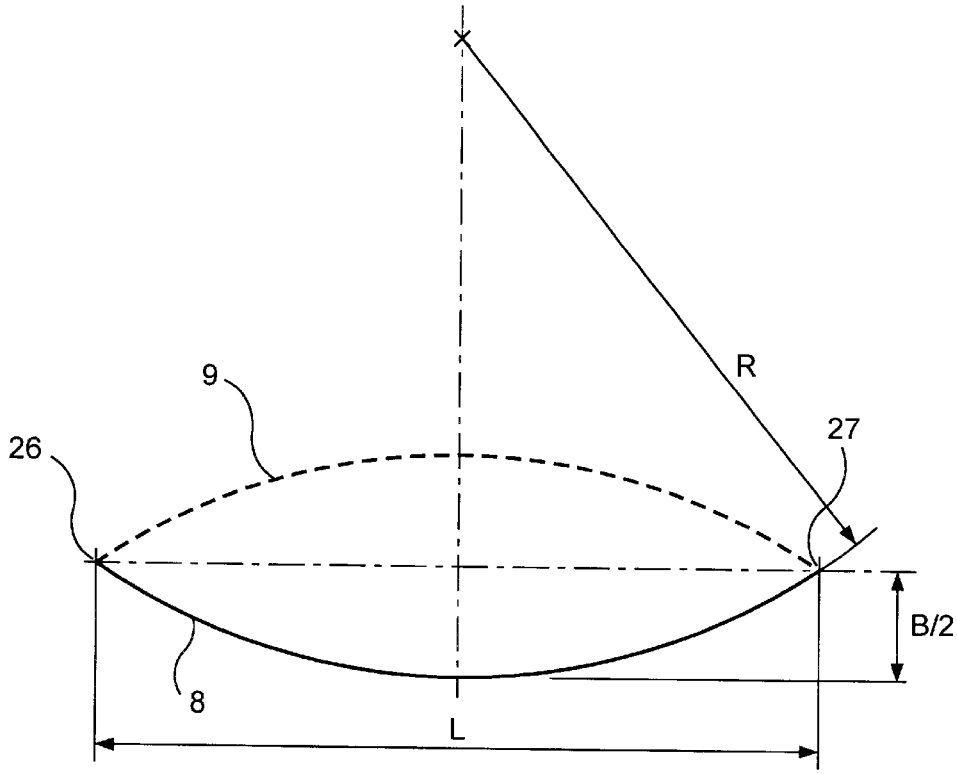
FIG. 11 illustrates an example of geometric proportions.
Figure 12:
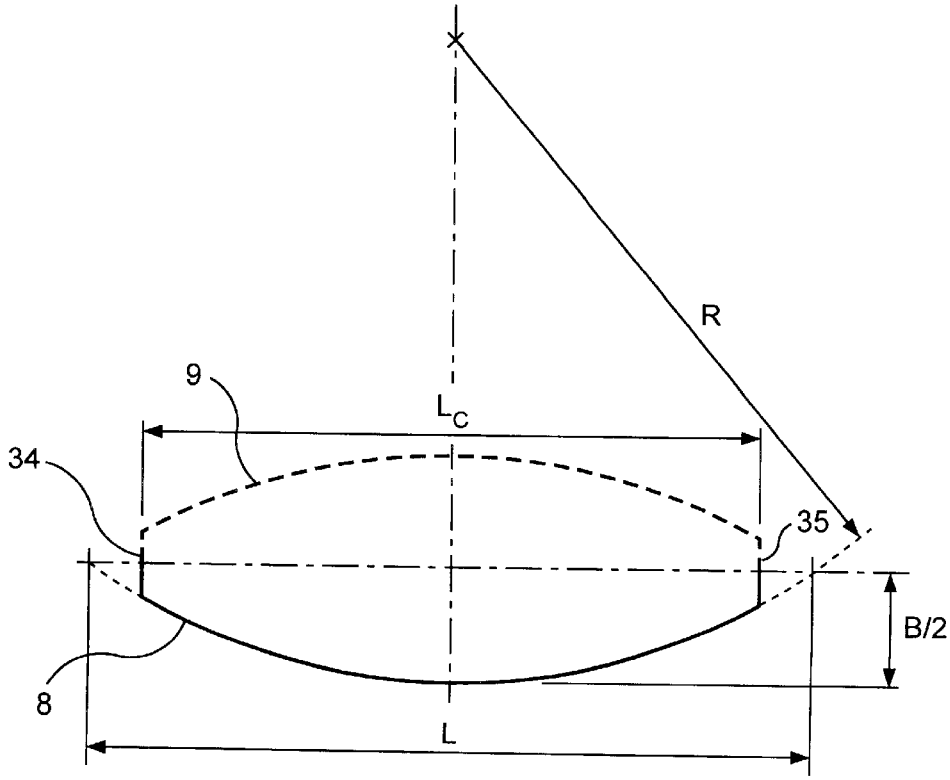
FIG. 12 illustrates an example of geometric proportions.

FIGS. 11 and 12 illustrate example geometric proportions. The variables L, B, B/2, R, and Lc may be calculated using formulas for a circular segment when several values are provided. Thus, a plate having a length L=100 and a width B=54 yields a ratio L/B of 1.85, and, in the case of a circular segment, the result is a value of 60 for the radius of curvature and a ratio of the radius of curvature to the width of approximately 1.1.

For a plate having a ratio L/B of 1.2, the ratio to width is approximately 0.61 for radius of curvature R in the case of a circular segment.

For a plate having a ratio L/B of 4, the ratio to width is approximately 4.25 for radius of curvature R in the case of a circular segment.

FIG. 12 illustrates a geometry having flattened regions 34, 35 at the ends, which results in a decreased length Lc with respect to the geometry illustrated in FIG. 11 including corners 26 and 27 and length L.

The typical radius of curvature for corners 26, 27 is in the range of 1 to 10 mm.

What is claimed is:

1. A holder for securing a mop to an end of a handle, the mop including a plurality of relatively movable and absorbent strips of a textile material, the holder comprising:

a headpiece including at least two edge regions configured to cooperate with the strips, a ratio of a length of the headpiece to a width of the headpiece being between 1.2 and 4; and plate, the strips being clampingly engageable between the headpiece and the plate; wherein the edge regions extend in a direction of a longitudinal axis of the holder, each of the edge regions having a radius of curvature that is between 0.61 and 4.25 times the width of the headpiece, the radius of curvature being one of the following:

a) a constant radius of curvature, and b) a sectionally changing radius of curvature.

2. The holder according to claim 1, wherein the strips are clampingly engageable between the headpiece and the plate at an angular displacement relative to each other.

3. The holder according to claim 1, wherein strips are clampingly engageable between the headpiece and the plate substantially at a right angle to a longitudinal axis of the handle.

4. The holder according to claim 1, wherein the ratio of the length of the headpiece to the width of the headpiece is greater than 1.6.

5. The holder according to claim 1, wherein the edge regions define at least two corners disposed at ends of the headpiece bordering the length of the headpiece.

6. The holder according to claim 1, wherein the edge regions define a flattened region at each end of the headpiece bordering the length of the headpiece, the flattened region preventing acute-angled corners.

7. The holder according to claim 2, wherein corners are disposed outside of ends of the headpiece bordering the length of the headpiece.

8. The holder according to claim 1, wherein each edge region includes at least one circular segment.

9. The holder according to claim 1, wherein, in the region that strips are clampingly engageable, the holder is in mirror symmetry about the longitudinal axis of the holder.

10. The holder according to claim 1, wherein the radius of curvature of a first one of the edge regions is greater than the radius of curvature of a second one of the edge regions.

11. The holder according to claim 1, wherein an angle formed between tangents to ends of the headpiece bordering the length of the headpiece is less than or equal to 90°.

12. The holder according to claim 1, wherein the edge regions are curved downwardly toward corners thereof in a three-dimensional manner.

13. The holder according to claim 1, further comprising: a tilting joint connecting the holder to the handle, the tilting joint configured to permit the handle to be tilted in the direction of the longitudinal axis of the holder.

14. The holder according to claim 10, further comprising: an arrangement configured to restrict a tilting angle between a vertical to the longitudinal axis of the holder to ±60° with respect to the vertical.

15. The holder according to claim 14, wherein the arrangement is configured to restrict the tilting angle to ±25° with respect to the vertical.

16. The holder according to claim 1, wherein a surface area of the plate is greater than a surface area of the headpiece.

17. The holder according to claim 1, wherein at least one of the headpiece and the plate is dome-shaped.

18. The holder according to claim 17, wherein the at least one of the headpiece and the plate is concave.

19. The holder according to claim 17, wherein an edge is formed at an intersection of dome-shaped partial sections of the at least one of the headpiece and the plate.

20. The holder according to claim 1, wherein corners of the holder are rounded with a radius between 0.05 times the width and 0.25 times the width.

21. The holder according to claim 1, wherein the ratio of the length to the width is less than or equal to 2.4 and a ratio of the radius of curvature to the width is less than or equal to 3.38.

* * * * *